US005642866A

United States Patent [19]

Nieding

[11] Patent Number: 5,642,866

[45] Date of Patent: Jul. 1, 1997

[54] ROLL OF TAPE PLUS HOLDER

[75] Inventor: Detlef Nieding, Schenefeld, Germany

[73] Assignee: Beiersdorf Aktiengesellschaft, Hamburg, Germany

[21] Appl. No.: 564,532

[22] Filed: Mar. 4, 1996

[51] Int. Cl.[6] ..... B65D 85/67

[52] U.S. Cl. ..... 242/588.4; 206/395

[58] Field of Search ..... 242/588, 588.3, 242/588.4; 206/395, 396

[56] References Cited

U.S. PATENT DOCUMENTS

| | | | |
|---|---|---|---|
| 1,889,933 | 12/1932 | Pratt | 206/396 |
| 2,217,397 | 10/1940 | Armitt | 206/395 |
| 2,984,396 | 5/1961 | Gadiel | 242/588.3 |
| 3,013,653 | 12/1961 | Hedin | 242/588.4 |
| 3,014,578 | 12/1961 | Tolaas | 242/588.4 |
| 3,106,288 | 10/1963 | Bolding | 242/588.4 |
| 3,401,792 | 9/1968 | Tolaas | 206/396 |
| 3,448,852 | 6/1969 | Dunning | 242/588.4 |
| 3,627,118 | 12/1971 | Daggs | 242/588.4 |
| 4,140,218 | 2/1979 | Forte | 206/395 |
| 4,239,110 | 12/1980 | Enke et al. | 242/588.4 |

*Primary Examiner*—John P. Darling
*Attorney, Agent, or Firm*—Sprung Horn Kramer & Woods

[57] ABSTRACT

A holder for a roll of tape having a circular hollow core, comprising first and second spaced faces, a first connector connecting the tops of the first and second faces, a second connector connecting the bottoms of the first and second faces, securing the holder into a loop wherein the faces plus connectors in lateral elevation define a rectangle of a height and width to receive a roll of tape, first and second aligned openings in the first and second faces respectively at a location higher than the center of the tape roll, and an inwardly foldable first flap on at least one of the faces, said flap being of a dimension so that upon inward folding it prevents the roll form being withdrawn from the holder.

8 Claims, 5 Drawing Sheets

ROLL OF TAPE PLUS HOLDER

The invention relates to a novel holder for a roll of tape, and to the combination of such a roll and novel holder.

BACKGROUND OF THE INVENTION

Rolls of tape for a variety of purposes are well known. They generally comprise a very long strip of paper, cellophane or plastic carrying adhesive on one or both faces. Usually the band is from 1 to 4 cm in width with adhesive on only one face, wound onto a hollow core. The core can be of molded plastic, heavy cardboard, or the like, formed into a hollow or empty circle of about 4 to 20 cm diameter, e.g. about 6 cm diameter. The core is of course of the same width as the band of tape. The tapes can be individually wound, or several tapes can be wound side-by-side or a band several meters wide can be wound onto a hollow tube several meters long and individual tape-plus-core sliced from the whole in the desired width, like slices from a large salami, either serially or in parallel.

Such tape-plus-core articles are usually wrapped and so sold. The user unwraps and unwinds the desired length of tape, usually placing it back flat on a work surface for future use. In such flat condition it takes up a relatively large amount of area. Further one must pick it up for each use.

Holders are known to maintain the tape in vertical position during use but they are complex and/or expensive.

OBJECT

It is accordingly an object of the present invention to provide a tape holder which is simple and inexpensive.

SUMMARY OF THE INVENTION

This and other objects are realized in accordance with the present invention pursuant to which there is provided a holder which is simple and inexpensive. It can be included in the package for the roll of tape when sold without significantly increasing its weight or volume. It can even assist in the display of the goods at the point of sale.

In accordance with the invention there is provided a holder for a roll of tape having a circular hollow core, comprising first and second spaced faces, a first connector connecting the tops of said first and second faces, a second connector connecting the bottoms of said first and second faces, means for securing said holder into a loop wherein said faces plus connectors in lateral elevation define a rectangle of a height and width to receive a roll of tape, first and second aligned openings in said first and second faces respectively at a location higher than the center of said tape roll, and an inwardly foldable first flap on at least one of said faces, said flap being of a dimension so that upon inward folding it prevents the roll from being withdrawn from said holder.

PREFERRED EMBODIMENT

Advantageously, the holder is formed of a single fiat sheet of deformable material longitudinally comprising said first face, said first connector, said second face and said second connector, said sheet having transverse lines to facilitate folding into said rectangular holder configuration.

Desirably such first flap is of such size and is so located that inward folding of the flap produces a friction lock with the inside of said hollow core of said roll. Desirably said inwardly displaceable first flap in its face is immediately adjacent its opening, whereby inward folding of said flap enlarges the size of said opening in said face. A transverse line may be provided to facilitate inward folding of said first flap.

In another embodiment there is provided an extension of one of said connectors extending along one of said faces beyond said first flap, said extension just behind said first flap, having a second flap which is also inwardly fordable, said second flap being positioned so that inward folding of said first flap causes inward folding of said second flap causing said second flap to engage said hollow tubular core to secure said core to said holder, there also being provided a transverse line on said extension facilitating its inward displacement. To facilitate securing of said flap within said core hollow, said extension at the sides of its displaceable second flap has diagonal score lines facilitating entry of said second flap into said hollow core and physical lock between said second flap and said core.

The holder can be sold as a flat blank carrying an adhesive which can easily effect erection. Preferably erection is effected before packaging so the point of sale article comprises the erected, adhered holder carrying the roll of tape.

DRAWINGS

The invention will be further described in the accompanying drawings wherein.

Figure 1:
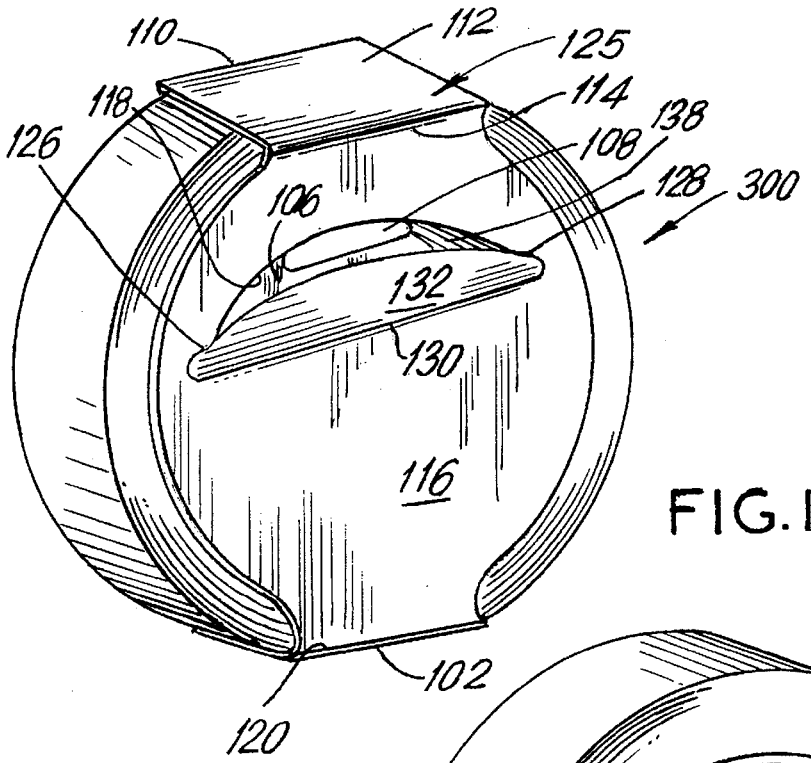
FIG. 1 is a perspective view of a roll of tape plus holder.
Figure 4:
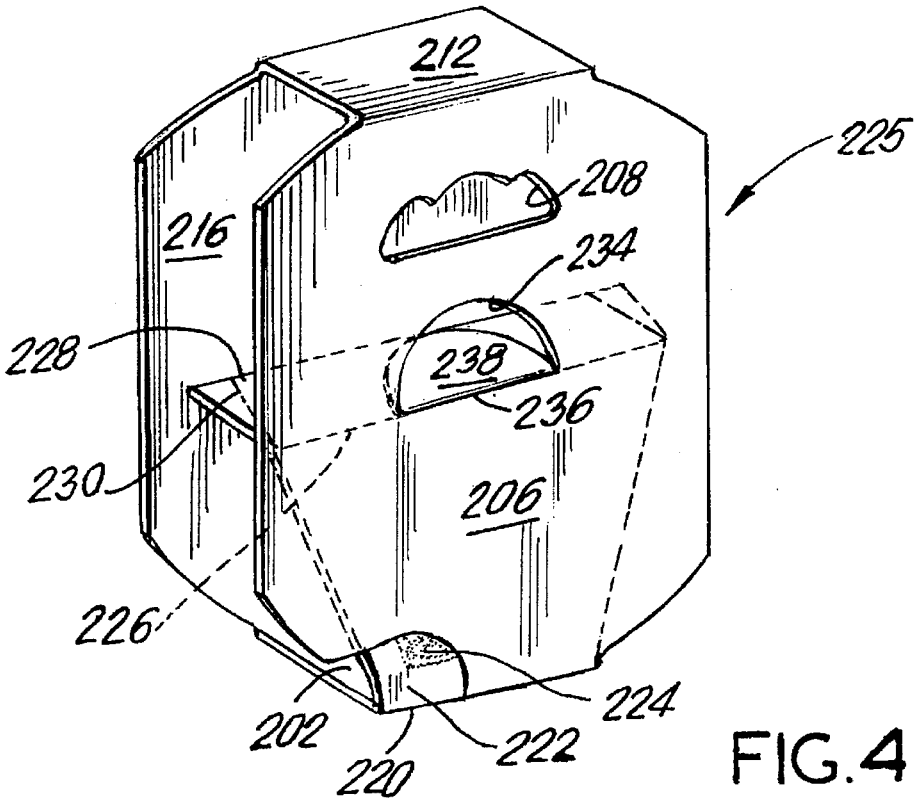
FIG. 4 is a perspective view of another embodiment of a holder.
Figure 5:
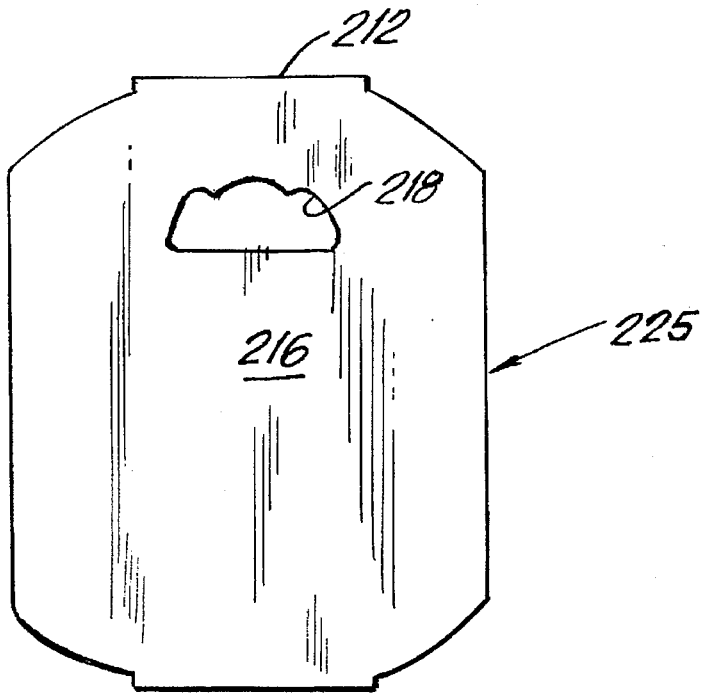
FIG. 5 is a front view of the reverse face of the holders of FIG. 3 and 4, both the same.
Figure 8A:
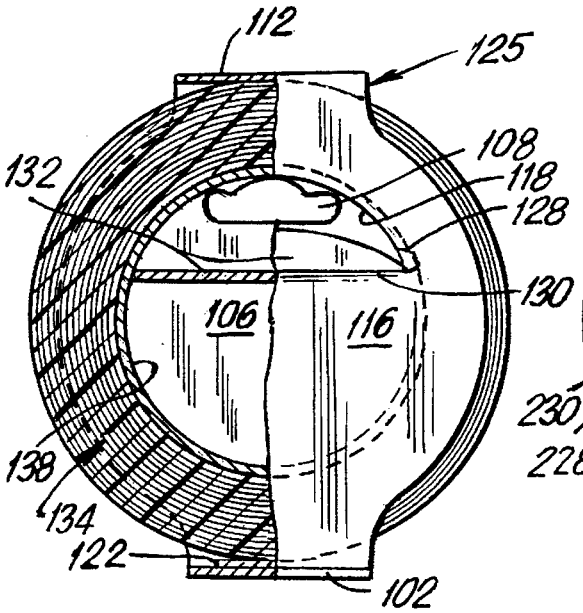
Figure 8B:
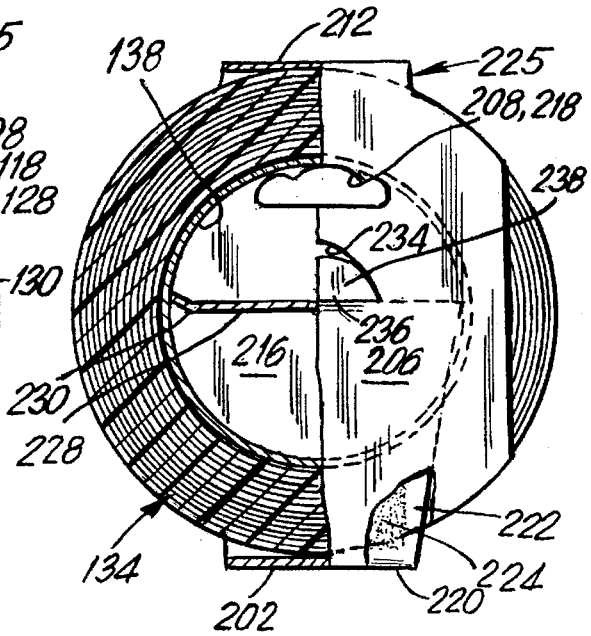
Figure 9:
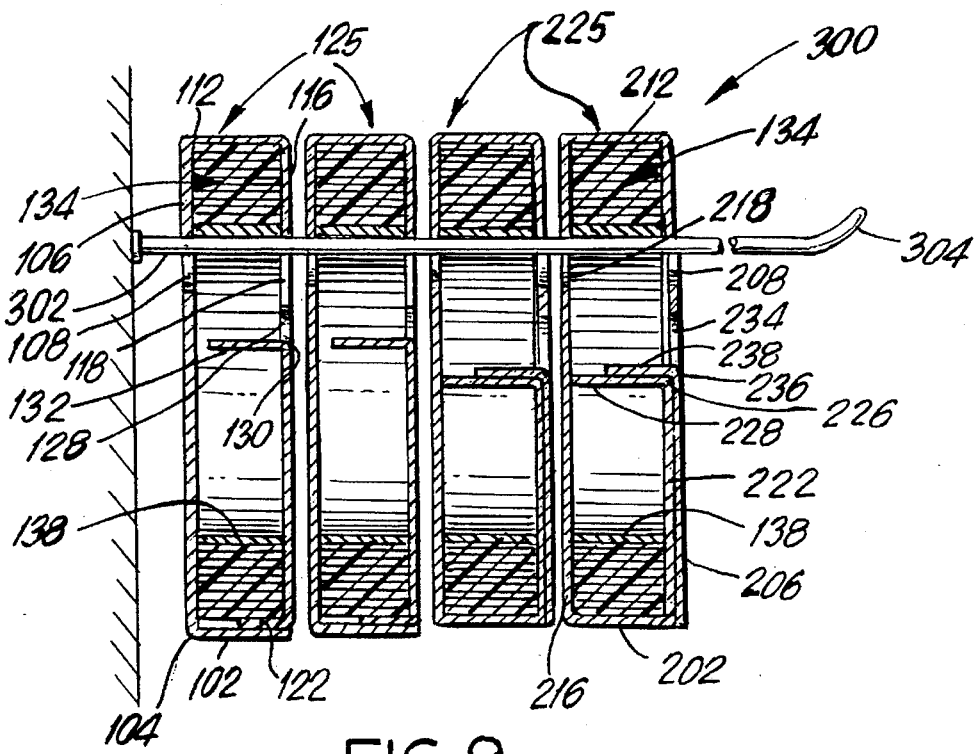

FIG. 8*a* is a half-section half-front elevation of the holder plus tape of FIG. 1;

FIG. 8*b* is a half-section half-front elevation of the holder of FIG. 4, plus tape; and FIG. 9 is a view of a rod projecting from a wall with two rolls of tape plus holder of each of FIGS. 1 and 4, shown in section.

DETAILED DESCRIPTION

Figure 6:
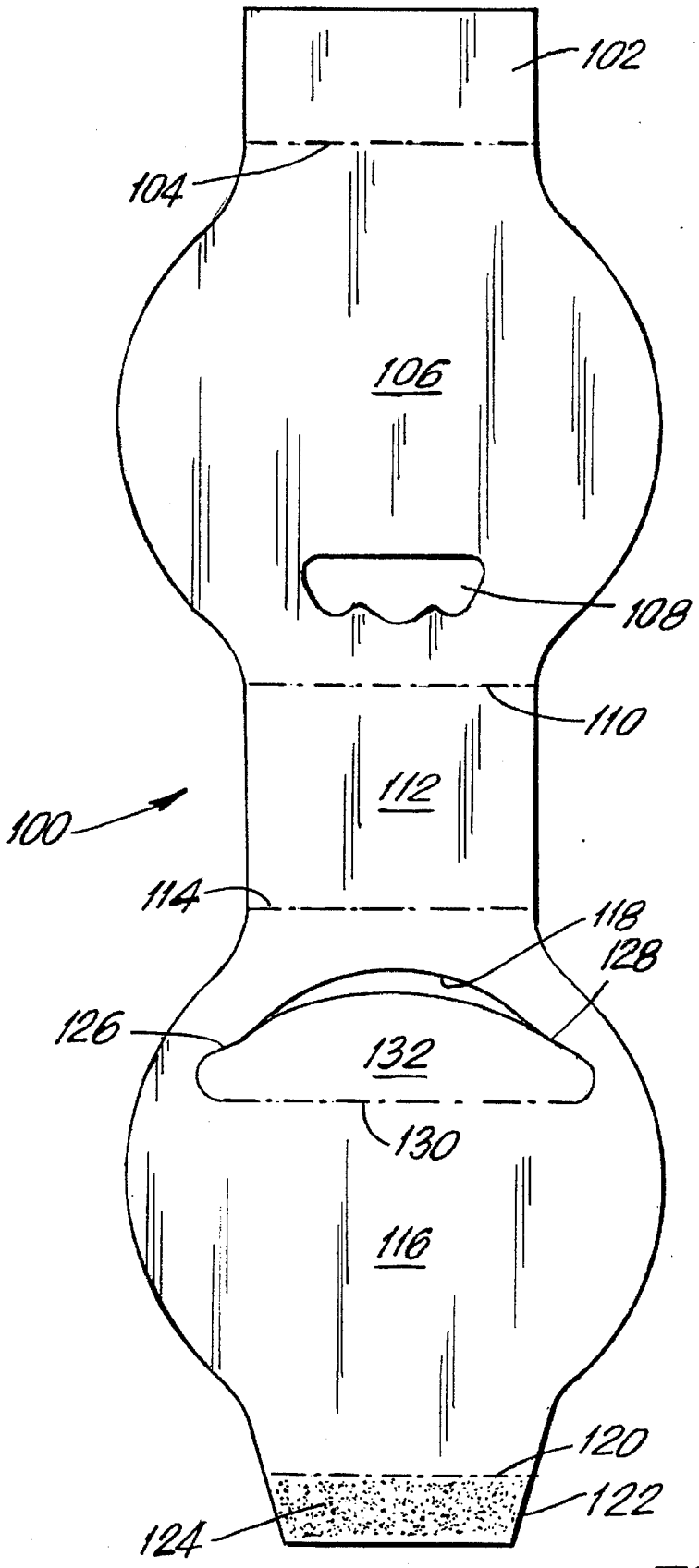
FIG. 6 is a plan view of a blank before erection into the holder of FIG. 3.

Referring now more particularly to the drawings, in FIG. 6 there is shown a blank 100 of cardboard or thin plastic sheet. From top to bottom as illustrated, there is a portion which is later to constitute a first or bottom connector 102, a fold line 104 (made by perforations, weakening, thinning, or the like), a laterally enlarged portion to become first face 106 wherein there is provided an opening 108, a fold line 110, a portion later to serve as second or top connector I 12, a further fold line 114, another portion to become second face 116, opening 118, fold line 120, and sealing flap 122, on one face carrying adhesive 124.

The area around opening 118 is of special configuration, soon to be discussed.

Figure 3:
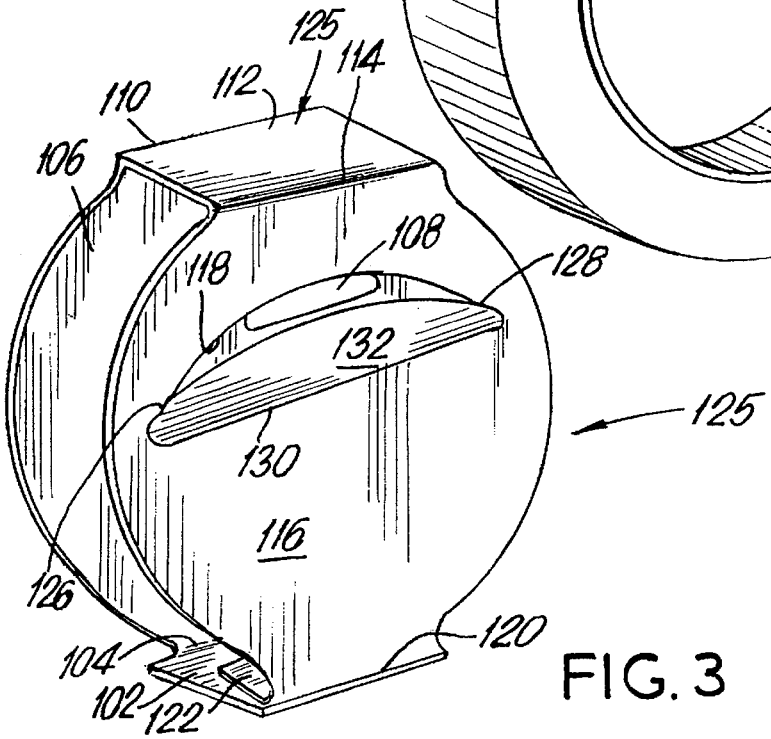
FIG. 3 is a perspective view of the holder of FIG. 1 without the roll of tape.

By bending the blank 100 along the fold lines and adhering flap 122 to bottom connector 102 in overlapping relationship therewith there is formed a holder 125 such as is shown in FIG. 3 Holder 125 has parallel faces and parallel top and bottom connectors so that in side view they form an empty rectangular body of the thickness of blank 100, except for a small double thickness where flap 122 overlaps connector 102.

Returning to opening 118, extending therefrom to left and to right are cuts 126 and 128. Each bulges out laterally then curves inward and ends, the ends being connected by a fold line 130. The portion of face I 16 above fold line 130 constitutes a flap 132.

Figure 2:
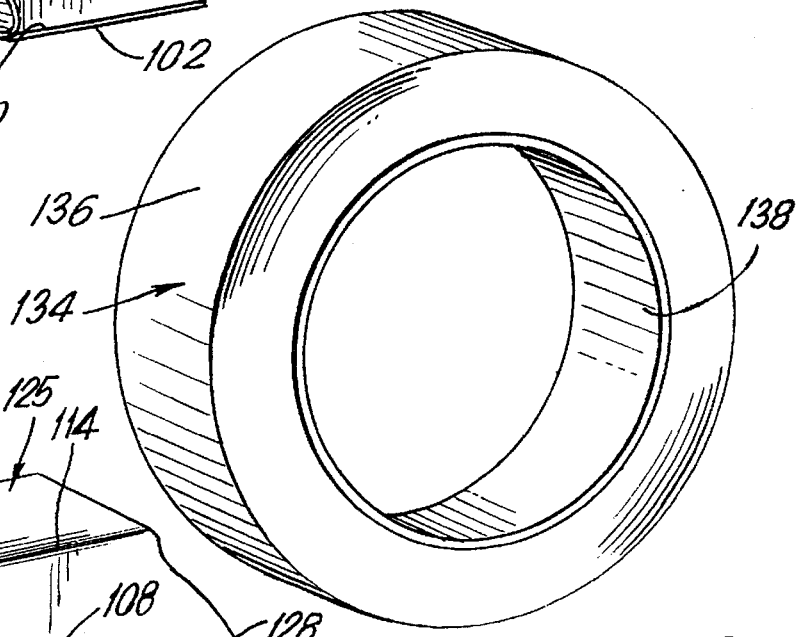
FIG. 2 is a perspective view of the tape of FIG. 1 without the holder.

In FIG. 2 there is shown a roll of tape 134 comprising a conventional plastic band 136 carrying adhesive on one surface and wound about a hollow core 138 in conventional manner.

Either manually or by machine the roll 134 is placed in holder 125 so that the hollow of core 138 is aligned with openings 108 and 118, advantageously the tops of all being of the same vertical elevation to reinforce one another when buying as in FIG. 8*b*.

Then flap 132 is folded or displaced inwardly about fold line 130 to enter the hollow of core 138. The lateral ears of flap 132 by size and location assist in preventing unintentional withdrawal of flap 132 from the hollow of core 138, due to friction, force fit and/or gravity as a result of the weight of the assembly 300 of FIG. 1 when hung as in FIG. 8*b*.

The flat bottom of the assembly 300 as shown in FIG. 1 permits it to stand upright on a desk or sales counter. Alternatively, for display or storage, as shown in FIG. 8*b*, a plurality of assemblies 300 are carried on a single wooden or metal rod 302 having an upwardly curved end 304 to prevent accidental falling off.

The assemblies 125 can each be wrapped in cellophane or plastic with the wrapping done so as to leave an open channel therethrough or they can each be fully enclosed and the package pressed over the rod end 304 to make small holes through which the rod 302 projects.

Such wrapping, if utilized, can be of a tape roll plus holder before or after folding of flap 132.

Figure 7:
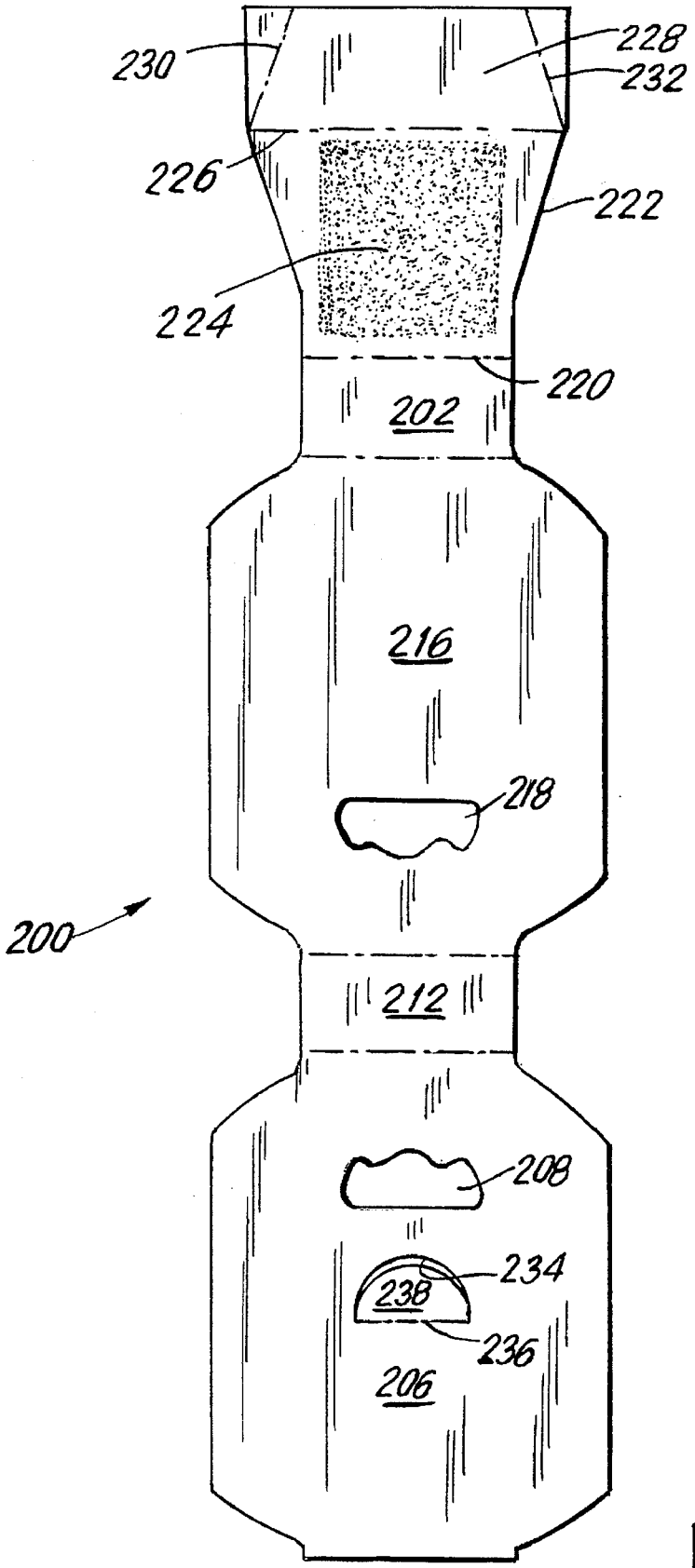
FIG. 7 is a plan view of a blank before erection into the holder of FIG. 4.

In FIG. 7 there is shown another embodiment of a blank for generally similar assembly and use, with a few modifications.

The blank 200 terminates at the bottom with face 216. At the other end beyond bottoms connector 202 there is a fold line 220, an extension 222 carrying adhesive 224, a fold line 226, a flap 228 and diagonal fold lines 230, 232, defining ears. In face 206 there is a cut 234 and a fold line 236, together defining a flap 238. The location of fold line 220 and 236 are such that displacement of flap 238 also causes displacement of flap 228 into the hollow of a tape roll core, also causing folding along diagonal fold lines 230, 232 which forms a tighter fit with the inside of the hollow core 138.

In this embodiment openings 208 and 218 are of the same shape. There is more adhesive and more adhesion in the holder 225 and the double thickness is longer and differently positioned than in the first embodiment.

The shapes, locations and configurations of the faces, openings, flaps and ears can be modified as can the location of adhesive.

Though not illustrated, either or both free sides of the top connectors 112, 212 can be pre-cut to form teeth to assist in cutting the tape, or a metal or plastic toothed cutting aid can be provided on the blank or loose to be manually placed and secured, if desired.

The holder can serve as an aid in display and sales, as shown in FIG. 9. There a rod 302 projects from a wall, ending in a slight upturn at its end 304. Two assemblies 300 were slid over the end 304 toward the wall, the rod extending through the aligned openings in holders and tapes. Thereafter two additional assemblies of FIG. 8*b* were slid over the end 304 of rod 302, through the aligned holder and tape openings of those assemblies. Thereby the plurality of assemblies can be carried above a work surface, i.e. not talking up any desk, shelf or work bench space.

The instant holders have use in storage of assemblies since their non-circular external configuration assists in preventing movement. Further they can even function as a dispenser during use, the tape roll rotating about the displaced flap.

It will be understood that the specification and examples are illustrative but not limitative of the present invention and that other embodiments within the spirit and scope of the invention will suggest themselves to those skilled in the art.

I claim:

1. A holder for a roll of tape having a circular hollow core, comprising first and second spaced faces, a first connector connecting the tops of said first and second faces, a second connector connecting the bottoms of said first and second faces, means for securing said holder into a loop, wherein said faces plus connectors in lateral elevation define a rectangle of a height and width to receive a roll of tape, first and second aligned openings in said first and second faces respectively at a location higher than the center of said tape roll, and an inwardly foldable first flap on at least one of said faces, said flap being of a dimension so that upon inward folding it prevents the roll from being withdrawn from said holder an extension of one of said connectors extending along one of said faces beyond said first flap, said extension just behind said first flap having a second flap which is also inwardly foldable, said second flap being positioned so that inward folding of said first flap causes inward folding of said second flap as well, inward folding of said second flap causing said second flap to engage said hollow tubular core to secure said core to said holder.

2. A holder according to claim 1, formed of a single flat sheet of deformable material longitudinally comprising said first face, said first connector, said second face and said second connector, said sheet having transverse lines to facilitate folding into said rectangular holder configuration.

3. A holder according to claim 1, wherein said first flap is of such size and being so located that inward folding of the flap produces a friction lock with the inside of said hollow core of said roll.

4. A holder according to claim 1, wherein said inwardly displaceable first flap in its face is immediately adjacent its opening, whereby inward folding of said flap enlarges the size of said opening in said face.

5. A holder according to claim 1, further including a transverse line to facilitate inward folding of said first flap.

6. A holder according to claim 1, including a transverse line on said extension facilitating it s inward displacement.

7. A holder according to claim 1, wherein said extension at the sides of its second flap has diagonal score lines facilitating entry of said second flap into said hollow core and physical lock between said second flap and said core.

8. In combination, a holder according to claim 1, and a roll of tape having a circular hollow core, the roll being positioned between the first and second faces of the holder with the hollow core of the roll forming a continuous passageway with the first and second openings, the first flap of said holder being folded inwardly, thereby preventing the roll from being withdrawn from the holder.

* * * * *